US008657418B2

(12) United States Patent
Kato et al.

(10) Patent No.: US 8,657,418 B2
(45) Date of Patent: Feb. 25, 2014

(54) INKJET HEAD AND RECORDING DEVICE

(75) Inventors: Masaki Kato, Tokyo (JP); Kiyoshi Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/598,250

(22) Filed: Aug. 29, 2012

(65) Prior Publication Data

US 2013/0050354 A1 Feb. 28, 2013

(30) Foreign Application Priority Data

Aug. 31, 2011 (JP) ..... 2011-188339

(51) Int. Cl.
*B41J 2/045* (2006.01)

(52) U.S. Cl.
USPC ..... 347/71; 347/50; 347/68; 347/70; 347/72

(58) Field of Classification Search
USPC ..... 347/50, 71, 68, 70, 72
See application file for complete search history.

(56) References Cited

U.S. PATENT DOCUMENTS

| | | | |
|---|---|---|---|
| 6,231,169 | B1 | 5/2001 | Yazaki et al. |
| 2012/0069101 | A1 | 3/2012 | Kato et al. |

FOREIGN PATENT DOCUMENTS

| | | |
|---|---|---|
| JP | H11-291497 | 10/1999 |
| JP | 2003-237077 | 8/2003 |
| JP | 2004-82623 | 3/2004 |
| JP | 2005-144847 | 6/2005 |
| JP | 2005-254622 | 9/2005 |
| JP | 2012-61750 | 3/2012 |
| JP | 2012-76449 | 4/2012 |

*Primary Examiner* — Henok Legesse
(74) *Attorney, Agent, or Firm* — Cooper Dunham LLP

(57) ABSTRACT

Disclosed is an inkjet head including a fluid channel substrate on which individual liquid chambers are arranged, the individual liquid chambers being partitioned by liquid chamber partition walls; an oscillation plate that is formed on a surface facing openings of nozzles; actuators; wiring layer patterns that supplies driving signals to the actuators, the wiring layer patterns being formed above the corresponding liquid chamber partition walls; and a supporting substrate in which concave oscillation chambers are formed, the concave oscillation chambers being partitioned by supporting substrate partition walls. A width in the short direction of the supporting substrate partition wall is smaller than a width in the short direction of the liquid chamber partition wall and greater than a width of the wiring layer pattern.

5 Claims, 6 Drawing Sheets

INKJET HEAD AND RECORDING DEVICE

BACKGROUND OF THE INVENTION

1. Field of the Invention

Embodiments of the present invention relate to an inkjet head and a recording device including the inkjet head. Specifically, the inkjet head causes pressure fluctuation to be generated in individual liquid chambers, and thereby the inkjet head sprays liquid from infinitesimal nozzles formed in the corresponding individual liquid chambers.

2. Description of the Related Art

An inkjet head and a recording device including the inkjet head have conventionally been known such that the inkjet head causes pressure fluctuation to be generated in individual chambers, and thereby the inkjet head sprays liquid from infinitesimal nozzles formed in the individual chambers. As a method for generating the pressure fluctuation in the individual liquid chambers of the inkjet head, many methods have already been realized and implemented in products.

For example, the thermal inkjet method and a method using an actuator can be considered. In the thermal inkjet method, liquid is vaporized by disposing a heater in the individual liquid chamber, and the pressure fluctuation caused by the vaporization is utilized. In the method using the actuator, the actuator is disposed in the individual liquid chamber. The method using the actuator can further be classified depending on the type of the actuator. For example, a piezoelectric element method and an electrostatic method have been known.

In the method using the actuator, various types of ink corresponding to various physical properties can be utilized. On the other hand, for the method using the actuator, high densification of the arrangement of the liquid chambers and downsizing of the head have been difficult. However, a technique of high densification is being established. In the technique, a so called "Micro Electro Mechanical Systems (MEMS)" process is utilized.

For example, the high densification can be realized by laminating an oscillation plate, an electrode, and a piezoelectric material on the individual liquid chamber by using the thin-film forming technology, and by patterning an individual piezoelectric element and wirings by using a semiconductor device manufacturing process (photolithography). For example, Patent Document 1 (Japanese Patent Laid-Open Application No. 2005-144847) discloses a technique for patterning a wiring layer.

Further, when a piezoelectric element formed by a thin film process is utilized, since the oscillation plate has a thin film structure having a thickness of several micro meters, the oscillation plate tends to be deformed by a residual stress due to the lamination of the piezoelectric elements. Further, since a thickness of a substrate that forms a fluid channel is small, it is preferable that sufficient stiffness be ensured and processing accuracy during a manufacturing process be improved. As a countermeasure for these problems, Patent Document 2 (Japanese Patent Laid-Open Application No. 2004-082623) and Patent Document 3 (Japanese Patent Laid-Open Application No. H11-291497) disclose a method in which a supporting substrate is utilized. In the method, end portions of the oscillation plate are reinforced by joining the piezoelectric elements with the supporting substrate, while disposing partition walls between the piezoelectric elements. Thereby the stiffness of the fluid channel substrate is improved. Namely, the crosstalk that accompanies the high densification of the arrangement of the liquid chambers can be reduced, and at the same time, handling in the manufacturing process can be improved. Thereby mass productivity is improved.

For a structure where the supporting substrate is joined with the fluid channel substrate, individual electrodes and a common electrode that are extended from an upper electrode and a lower electrode by patterning of the wiring layer may be required to be extended outside a joining area where the supporting substrate is joined with the fluid channel substrate, so that the individual electrodes and the common electrode are connected to a driving circuit. In order to improve reliability of the bonding between the supporting substrate and the fluid channel substrate, the height of the joining area may be adjusted to be equal to that of the layer structure.

In Patent Document 1, the effect of the positional shift of the supporting substrate on the liquid discharging property is mitigated by making the width of the partition wall of the supporting substrate smaller than the width of the piezoelectric body formed on the partition wall of the fluid channel or the width of the laminated film including the upper electrode. However, the layer structure of the partition wall portion of the supporting substrate is significantly different from the layer structure at the joining area.

Further, in Patent Document 2, the difference between the heights of the joining areas due to the difference between the layer structures is compensated by filling a resin material or the like. However, the compensation may not be sufficient from the viewpoints of the bonding strength and the joining reliability between the supporting substrate and the fluid channel substrate. Therefore, when the deformation occurs such that the whole fluid channel substrate is bent, the effect of the crosstalk among the individual liquid chambers is enlarged. In addition, when the sufficient joining reliability between the supporting substrate and the fluid channel substrate is not ensured, a larger width of the joining area between the supporting substrate and the fluid channel substrate may be required. Consequently, the downsizing of the inkjet head may be difficult.

SUMMARY OF THE INVENTION

The embodiments of the present invention have been developed to overcome the above-described circumstances. An objective of the embodiments of the present invention is to provide an inkjet head and a recording device that improve joining reliability between a fluid channel substrate and a supporting substrate, and that facilitate downsizing.

In order to achieve the above objective, the following configurations have been adopted.

In one aspect, there is provided an inkjet head including a fluid channel substrate on which individual liquid chambers are arranged in a short direction, wherein the individual liquid chambers are partitioned by liquid chamber partition walls, and the individual liquid chambers communicate with ink supply ports; an oscillation plate that is formed on a surface facing openings of nozzles disposed in the corresponding individual liquid chambers; actuators that are formed by laminating a lower electrode, a piezoelectric element, and an upper electrode on the oscillation plate; wiring layer patterns configured to supply driving signals to the actuators and configured to connect individual electrodes and a common electrode to the upper electrode, wherein the wiring layer patterns are formed above the corresponding liquid chamber partition walls; and a supporting substrate in which concave oscillation chambers disposed at positions facing the corresponding actuators are formed, the concave oscillation chambers being partitioned by supporting substrate partition walls, wherein the supporting substrate partition walls are joined to the corresponding liquid chamber partition walls through laminated films including the wiring layer patterns. A width in a short direction of each of the supporting substrate partition walls is set to be smaller than a width in the short direction of each of the liquid chamber partition walls, and set to be greater than a width of each of the wiring layer patterns.

In another aspect, there is provided a recording head including an inkjet head. The inkjet head includes a fluid channel substrate on which individual liquid chambers are arranged in a short direction, wherein the individual liquid chambers are partitioned by liquid chamber partition walls, and the individual liquid chambers communicate with ink supply ports; an oscillation plate that is formed on a surface facing openings of nozzles disposed in the corresponding individual liquid chambers; actuators that are formed by laminating a lower electrode, a piezoelectric element, and an upper electrode on the oscillation plate; wiring layer patterns configured to supply driving signals to the actuators and configured to connect individual electrodes and a common electrode to the upper electrode, wherein the wiring layer patterns are formed on the corresponding liquid chamber partition walls; and a supporting substrate in which concave oscillation chambers disposed at positions facing the corresponding actuators are formed, the concave oscillation chambers being partitioned by supporting substrate partition walls, wherein the supporting substrate partition walls are joined to the corresponding liquid chamber partition walls through laminated films including the wiring layer patterns. A width in a short direction of each of the supporting substrate partition walls is set to be smaller than a width in the short direction of each of the liquid chamber partition walls, and set to be greater than a width of each of the wiring layer patterns.

According to the embodiments of the present invention, the joining reliability between the fluid channel substrate and the supporting substrate can be improved, while facilitating the downsizing.

Other objects, features and advantages of the present invention will become more apparent from the following detailed description when read in conjunction with the accompanying drawings.

DETAILED DESCRIPTION OF THE PREFERRED EMBODIMENTS

First Embodiment

Hereinafter, a first embodiment of the present invention will be explained by referring to FIGS. 1 and 2.

Figure 1:
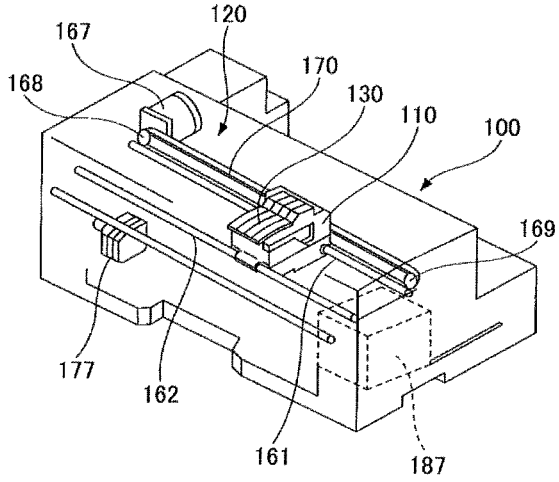
FIG. 1 is a perspective view schematically showing a recording device according to a first embodiment.
Figure 2:
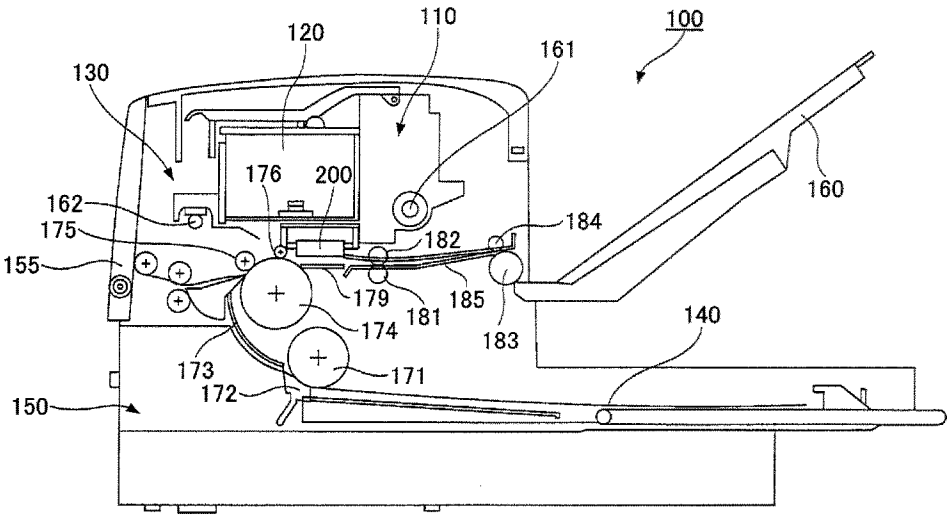
FIG. 2 is a cross-sectional view of the recording device according to the first embodiment.

FIG. 1 is a perspective view schematically showing a recording device according to the first embodiment. FIG. 2 is a cross-sectional view of the recording device according to the first embodiment. The recording device 100 is an inkjet image forming device on which an inkjet head is mounted.

The recording device 100 according to the first embodiment includes a printing unit 130 including a carriage 110 that is movable in a main scanning direction; an inkjet head 200 mounted on the carriage 110; and an ink cartridge 120 that supplies ink to the inkjet head 200. A paper feed cassette (paper feed tray) 150 on which many sheets of paper 140 can be stacked is detachably attached to a lower portion of the recording device 100 from the front side.

Further, the recording device 100 includes an openable and closable manual feed tray 155 for manually feeding sheets of recording paper 140. The sheet of recording paper 140 is fed from the paper feed cassette 150 or the manual feed tray 155. After a desired image is recorded by the printing unit 130, the recording device 100 discharges the sheet onto a paper discharging tray 160, which is attached to a rear face side of the recording device 100.

The printing unit 130 supports the carriage 110 by a main guide rod 161 and a sub guide rod 162 that are guide members horizontally supported by left and right side plates (not shown), so that the carriage 110 can be slide in the main scanning direction. The carriage 110 includes inkjet heads 200 that discharge ink droplets in corresponding colors of yellow (Y), cyan (C), magenta (M), and black (Bk). Each of the inkjet heads 200 has plural ink discharging ports (nozzles) that are arranged in a direction crossing the main scanning direction. The inkjet heads 200 are attached to the carriage 110 so that ink droplet discharging directions become downward.

The ink cartridges 120 for supplying the corresponding colors of ink to the inkjet head 200 are attached to the carriage 110. Here, the ink cartridges 120 are replaceable.

Each of the ink cartridges 120 includes an air inlet that communicates with the air outside and that is disposed at an upper portion of the ink cartridge 120; a supply port that supplies the ink to the corresponding inkjet head 200 and that is disposed at a lower portion of the ink cartridge 120; and a porous body that is filled with the ink and that is disposed inside the ink cartridge 120. The ink supplied to the corresponding inkjet head 200 is maintained to have a slightly negative pressure by a capillary force of the porous body. In the first embodiment, the inkjet heads 200 corresponding to the colors of yellow, magenta, cyan, and black are utilized. However, a single inkjet head 200 that discharges the corresponding colors of ink droplets may be utilized.

The rear side of the carriage 110 (a downstream side in a sheet conveyance direction) is slidably fixed to the main guide rod 161. The front side of the carriage 110 (an upstream side in the sheet conveyance direction) is placed on the sub guide rod 162 so that it can be slid.

A timing belt 170 is suspended between a drive pulley 168 and a driven pulley 169. The drive pulley 168 is rotationally driven by a main scanning motor 167. The carriage 110 is fixed to the timing belt 170, and thereby the carriage 110 is moved and scans in the main scanning direction. The carriage 110 is reciprocally driven by forward and reverse rotations of the main scanning motor 167.

The recording device 100 includes a paper feed roller 171 and a friction pad 172 that separate the sheets of paper 140 and that feed the sheets of paper 140 on a sheet-by-sheet basis. The paper feed roller 171 and the friction pad 172 convey the sheet of paper 140 to a position below the inkjet heads 200. Additionally, the recording device 100 includes a guide member 173 that guides the sheet of paper 140 and a conveyance roller 174 that inverts and conveys the sheet of paper 140 that has been fed. Further, the recording device 100 includes a conveyance roller 175; and a tip roller 176. The conveyance roller 175 is pressed onto a circumferential surface of the conveyance roller 174. The tip roller 176 defines an angle in which the sheet of paper 140 is sent out from the conveyance roller 174. The conveyance roller 174 is rotationally driven by a sub scanning motor 177.

The recording device 100 includes a printing support member 179 that is a sheet guiding member for guiding the sheet of paper 140 that has been sent out from the conveyance roller 174 at the position below the inkjet heads 200. The width of the printing support member 179 corresponds to a moving range in the main scanning direction of the carriage 110. The recording device 100 includes a conveyance roller 181 and a spur 182 that are rotationally driven so as to send out the sheet of paper 140 in a paper discharging direction. The conveyance roller 181 and the spur 182 are disposed at a downstream side of the printing support member 179 in the paper conveyance direction. The recording device 100 further includes a paper discharging roller 183 and a spur 184 that send out the sheet of paper 140 to the paper discharging tray 160; and guide members 185 and 186 that form a paper discharging path.

During recording, the recording device 100 discharges the ink onto the staying sheet of paper 140 and records an amount corresponding to one line by driving the inkjet heads 200 in accordance with an image signal, while moving the carriage 110. Subsequently, the recording device 100 records the next line, after conveying the sheet of paper 140 by a predetermined amount.

When the recording device 100 receives a recording termination signal or a signal indicating that a rear end of the sheet of paper 140 reaches a recording area, the recording device terminates the recording operation, and discharges the sheet of paper 140.

The recording device includes a recovering device 187 that recovers the inkjet heads 200 from a discharging failure. The recovering device 187 is disposed at a position outside the recording area on the right end side in the moving direction of the carriage 110. The recovering device 187 includes a cap unit; a suction unit; and a cleaning unit. During a print waiting state, the carriage 110 is moved at the side of the recovering device 187, and the cap unit caps the inkjet heads 200. In this manner, the wet condition of the discharging ports is maintained, and a discharging failure caused by drying of the ink is prevented.

Further, during recording, the recording device discharges ink that is not related to the recording. In this manner, the viscosity of the ink at all the discharging ports is homogenized, and a stable discharging capability is maintained.

When the discharging failure occurs in the recording device 100, the discharging ports (nozzles) of the inkjet heads 200 are sealed by the cap unit. Bubbles or the like are suctioned along with the ink from the discharging ports by the suction unit through a tube. The ink and dust adhering to the surface of the discharging ports are removed by a cleaning unit, and thereby the discharging failure is recovered.

Further, the suctioned ink is discharged to a waste ink reservoir (not shown) disposed at a lower portion of the main body of the image forming device 100, and the waste ink is absorbed and maintained by an ink absorber disposed inside the waste ink reservoir.

In this manner, when a heat resistant adhesive layer is utilized in the recording device 100 according to the first embodiment, since a peel off of an electrode layer does not occur, an ink droplet discharging failure due to a driving failure does not occur. Therefore, a stable ink discharging characteristic is obtained and missed printing of pixels is prevented. Consequently, the quality of the image is improved.

Figure 3:
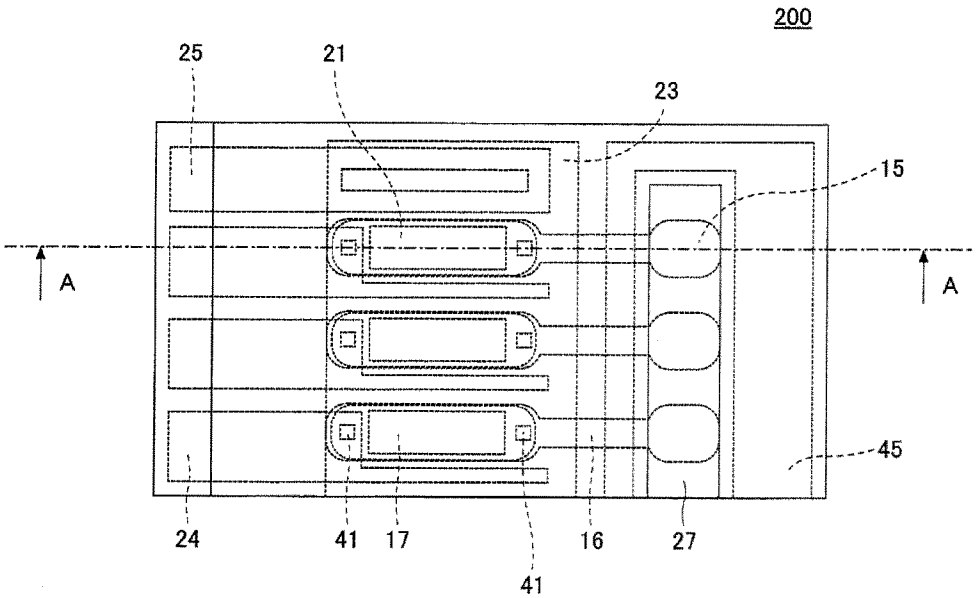
FIG. 3 is a top view of an inkjet head.
Figure 4:
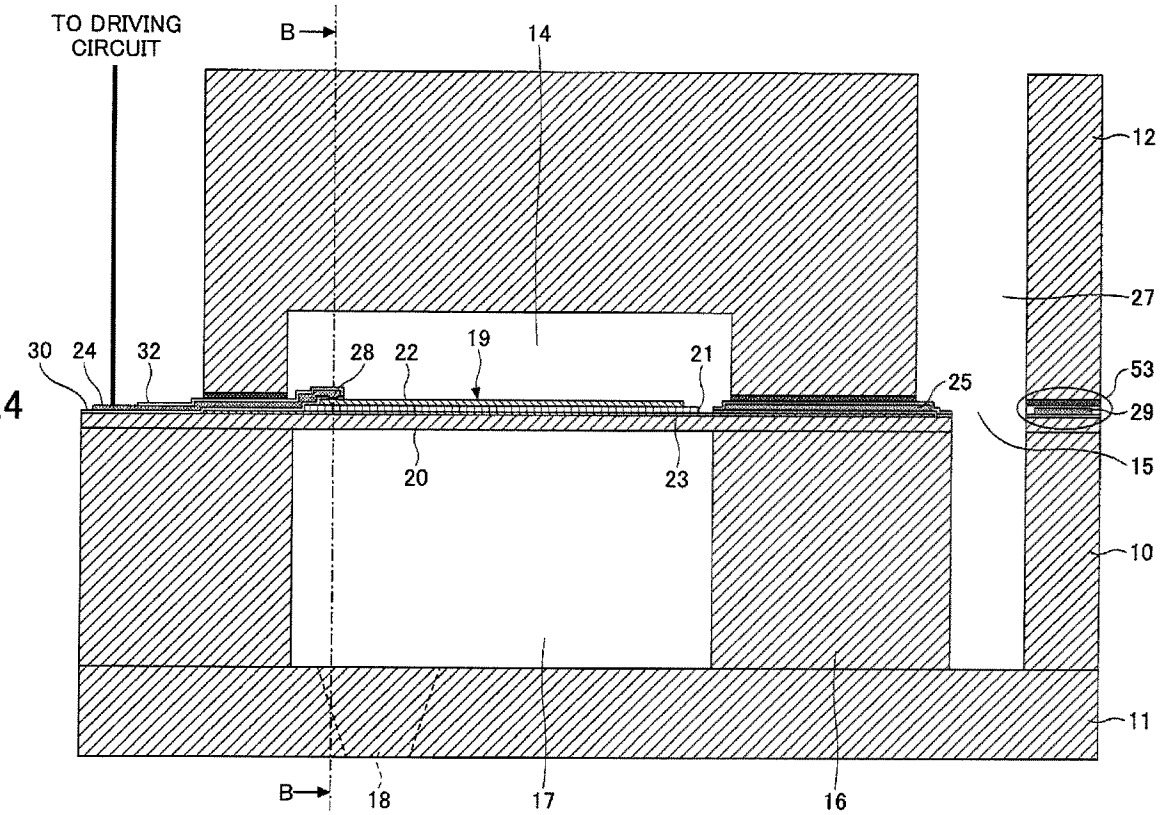
FIG. 4 is a diagram showing an A-A cross-section of the inkjet head.
Figure 5:
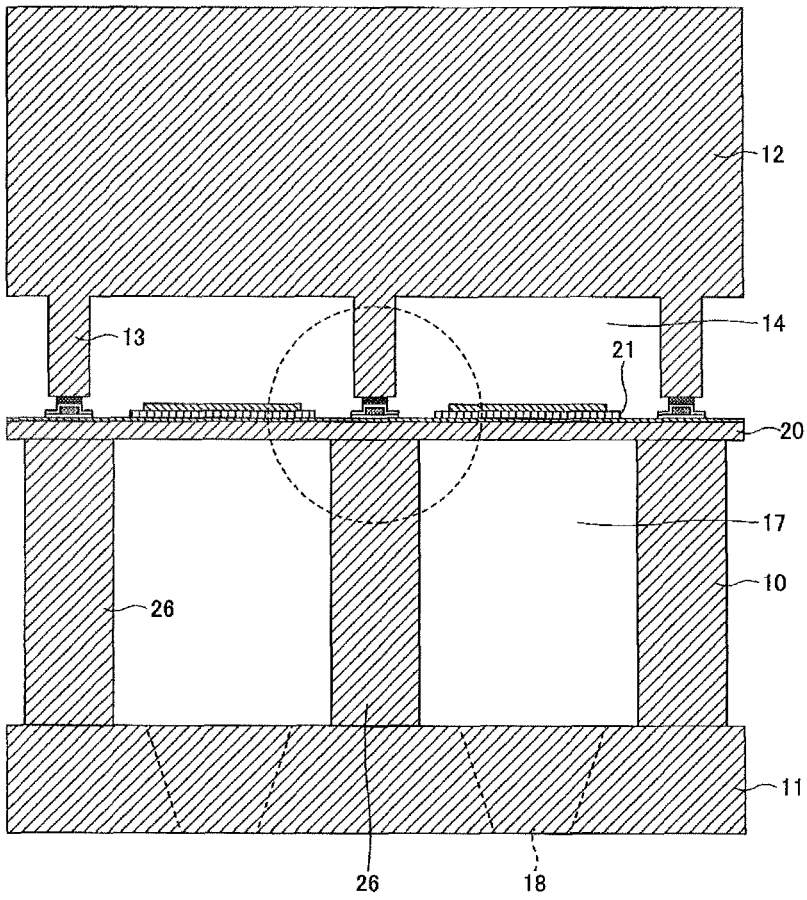
FIG. 5 is a diagram showing a B-B cross-section of the inkjet head.

Next, the inkjet head 200 according to the first embodiment is explained by referring to FIGS. 3-5. FIG. 3 is a top view of the inkjet head 200. FIG. 4 is a diagram showing an A-A cross-section of the inkjet head 200. FIG. 5 is a diagram showing a B-B cross-section of the inkjet head 200.

The inkjet head 200 according to the first embodiment includes, at least, a fluid channel substrate 10; nozzle plate 11; and a supporting substrate 12.

The supporting substrate 12 includes oscillation chambers 14 that are partitioned by plural supporting substrate partition walls 13. The oscillation chambers 14 are arranged in parallel in the width direction of the supporting substrate 12 (cf. FIG. 5). The fluid channel substrate 10 forms a fluid channel where ink or a liquid supplied from an ink supply port 15 flows to an individual liquid chamber 17 through a fluid resistance portion 16. The fluid resistance portion 16 is formed for each oscillation chamber 14 to have a width that is smaller than the width of the oscillation chamber 14. The fluid resistance portion 16 maintains a fluid channel resistance of the ink that flows from the ink supply port 15 to the oscillation chamber 14 to be constant.

The nozzle plate 11 is joined to a lower portion of the fluid channel substrate 10. In the nozzle plate 11, nozzles 18 are formed. In the inkjet head 200, an oscillation plate 20 formed at an upper portion of the individual liquid chamber 17 is deformed to generate pressure fluctuation in the individual liquid chamber 17. In this manner, ink droplets are discharged from the nozzle 18. An actuator 19 that deforms the oscillation plate 20 is formed on the oscillation plate 20.

An upper electrode 22 is formed on the piezoelectric element 21 at the side of the oscillation chamber 14. A lower electrode 23 is formed between the piezoelectric element 21 and the oscillation plate 20. An individual electrode 24 for supplying an individual signal to the corresponding piezoelectric element 21 is extended from the upper electrode 22. A common electrode 25 for supplying a common signal to the corresponding piezoelectric element 21 is extended from the lower electrode 23. The individual electrode 24 and the common electrode 25 are formed at a wiring layer.

In the first element, ink droplets can be discharged by driving the actuator 19 by inputting driving signals to the upper electrode 22 and the lower electrode 23 through the individual electrode 24 and the common electrode 25.

The driving signals are input from a driving circuit that is connected to the individual electrode 24 and to the common electrode 25 using a suitable method. The individual liquid chambers 17 are arranged in a short direction of the fluid channel substrate 10. The individual liquid chambers 17 are divided by corresponding liquid chamber partition walls 26. For each of the individual liquid chambers 17, the ink supply port 15, the fluid resistance portion 16, and the nozzle 18 are formed.

The ink is supplied from an ink supply channel 27 that is formed on the supporting substrate 12 through the ink supply port 15. The ink is supplied to the ink supply channel 27 through an arbitrary supply channel. Incidentally, the above-described basic configurations of the liquid chamber and the electrodes have already been known as those of the inkjet head that utilizes the piezoelectric element.

Hereinafter, the inkjet head 200 according to the first embodiment will further be explained in detail.

In the inkjet head 200 according to the first embodiment, the nozzles 18 are arranged in an array or in a matrix on the nozzle plate 11. In the example of FIG. 4, the nozzles 18 can be arranged in an array by placing the nozzles 18 on a line in a depth direction. Further, by arranging the arrays of the nozzles 18 in the horizontal direction, the nozzles 18 can be arranged in a matrix.

As to a material of the nozzle plate 11, a suitable material can be selected from the viewpoint of the processing accuracy and the ease of assembly (mass-productiveness). As an example of the material of the nozzle plate 11, an inorganic material such as a metal, an alloy, Si, and a glass, and a resin material may be considered. As to a processing method of the nozzles 18, a method that is suitable for the material may be utilized. For example, machine processing such as press working, and the known processing method such as laser processing, electroforming processing, and etching may be utilized. The diameter of the nozzle 18 can be arbitrary designed depending on a physical property of the ink to be discharged, nozzle arrangement density, and/or a required discharging capability. In the first embodiment, it is preferable that the material of the substrate be a stainless steel and that the processing method be the press working, from the viewpoint of the homogeneity of the nozzle processing. When the press working is utilized, since the nozzles 18 are processed by the same metal mold, the processing stability may be improved.

Further, in the first embodiment, the discharging capability may be stabilized by applying the water-repellent processing to a discharging side of the nozzle plate 11. An arbitrary method may be utilized to bond the nozzle plate 11 to the fluid channel substrate 10. Known adhesive technology may be utilized.

The individual liquid chambers 17 are formed in the fluid channel substrate 10. The individual liquid chambers 17 communicate with the corresponding nozzles 18. The individual liquid chambers 17 are formed for the corresponding nozzles 18. When the pressure fluctuation is generated in the individual liquid chamber 17 through the actuator 19 and the oscillation plate 20, the corresponding nozzle 18 discharges liquid droplets. The individual liquid chamber 17 is connected to the ink supply port 15 through a fluid channel that forms the fluid resistance portion 16, which is shown in FIG. 4. The ink is supplied to the individual liquid chamber 17 through the ink supply channel 27 formed at the upper portion of the ink supply port 15. Similar to the nozzles 18, the ink fluid channel including the individual liquid chamber 17 and the fluid resistance portion 16 may be arranged in an array by placing the fluid channels on a line in the depth direction of FIG. 4.

As a material of the fluid channel substrate 10, an arbitrary material may be utilized. However, in the first embodiment, it is preferable to utilize a material that allows microfabrication, from the viewpoint of high densification. In order that the individual liquid chambers 17 be spaced apart by a pitch of less than or equal to 100 μm, and that the variations in the processing of the fluid channels be regulated within a range of several micro meters, it is preferable to use a semiconductor processing method. As a material of the fluid channel substrate 10, it is preferable to use a Si wafer.

When the Si wafer is used, it is preferable to utilize the photolithography as the processing method of the ink fluid channel including the individual liquid chamber 17. As the etching method, a wet etching method or a dry etching method may be selected. In the wet etching method, an alkaline etching solution is used. In a dry etching method, a plasma process is used. The thickness of the fluid channel substrate 10 may be arbitrary selected from the viewpoints of the discharging capability and the ability to be processed. However, it is preferable that the thickness of the fluid channel substrate 10 be within a range from 30 μm to 200 μm, and it is further preferable that the thickness be within a range from 30 μm to 100 μm. When the thickness of the fluid channel substrate 10 is within the above-described range, a fine discharging capability may be obtained, even if the nozzles 18 are spaced apart by a pitch of less than or equal to 100 μm.

As shown in FIG. 5, in the inkjet head 200 according to the first embodiment, the individual liquid chambers 17 are partitioned by the corresponding liquid chamber partition walls 26. It is preferable that the width of the liquid chamber partition wall 26 be set to be the width with which the processing accuracy and the stiffness are ensured. In the first embodiment, it is preferable that the width of the liquid chamber partition wall 26 be greater than or equal to a quarter of the width of the fluid channel substrate 10, and it is further preferable that the width of the liquid chamber partition wall 26 be greater than or equal to one-third of the width of the fluid channel substrate. When the width of the liquid chamber partition wall 26 is too small, the neighboring individual liquid chambers 17 may interfere with each other, because of bending. When the width of the liquid chamber partition wall 26 is too large, the nozzle arrangement density is lowered.

A suitable shape may be selected for the individual liquid chamber 17 depending on the discharging capability. Namely, the length of the individual liquid chamber 17 and the width of the B-B cross-section of the individual liquid chamber 17 in FIG. 4 may be suitably selected. When the length of the individual liquid chamber 17 is greater, the excluded volume may be enlarged, and larger liquid droplets may be discharged. However, since the resonant frequency between the ink and the structure of the individual liquid chamber 17 is lowered, the driving frequency is lowered. Therefore, it is preferable that the width of the B-B cross-section of the individual liquid chamber 17 be within a range from 30 μm to 150 μm and that the length of the individual liquid chamber 17 be within a range from 600 μm to 1500 μm.

In the individual liquid chamber 17 shown in FIG. 4, the fluid resistance portion 16 formed at the side of the ink supply port 15 has a function to reduce the reverse flow of the ink toward the side of the ink supply port 15 when the individual liquid chamber 17 is pressed, and a function to supply the ink to the individual liquid chamber 17 when the ink has been discharged and the individual liquid chamber 17 is in a decompressed state. The fluid resistance portion 16 at the side of the ink supply port 15 may have a shape such that its fluid resistance value is greater than that of the fluid resistance portion 16 at the side of the nozzle 16. In order to maintain the amount of the supply of the ink, the fluid resistance value and the inductance (inertia of the ink) may be adjusted to be within suitable ranges. Regarding the shape, a desired characteristic may be obtained by making the width or (and) depth of the fluid resistance portion 16 smaller than that of the individual liquid chamber 17, and by adjusting the length of the fluid resistance portion 16.

In the inkjet head 200 according to the first embodiment, the oscillation plate 20 is formed at the portion above the fluid channel substrate 10. The piezoelectric element 21 bends the oscillation plate 20 by stress and causes the volume of the individual liquid chamber 17 to be varied. In this manner, the oscillation plate 20 varies the pressure of the ink in the individual liquid chamber 17. Therefore, the oscillation plate 20 may have the film thickness that is suitable for the elastic deformation. As a material of the oscillation plate 20, a metal, an alloy, an inorganic material, or an organic material such as a resin may be used so that the oscillation plate 20 is elastically deformed by the stress from the piezoelectric element 21. Since an objective of the inkjet head 200 according to the first embodiment is to highly densify the nozzles 18 and to highly integrate the piezoelectric element 21, it is preferable to select a material and a processing method that are consistent with the processing method of the individual liquid chamber 17.

As a material of the oscillation plate 20, an arbitrary metal, an alloy, a dielectric material, a semiconductor may be utilized. However, in the first embodiment, it is preferable that a dielectric material, a semiconductor, or a laminated structure body thereof be utilized, from the viewpoints of the high stiffness and the ability to be processed. Examples of the dielectric material include oxides such as $Al_2O_3$, $ZrO_2$, $TiO_2$, $SiO_2$, and $Y_2O_2$; nitrides such as SiN, TIN, and AlN, and carbides such as TIC, and SiC. Examples of the semiconductor include silicone, poly-silicon, and amorphous silicone. A complex compound of these dielectric materials and/or semiconductor materials may be utilized. In addition, a laminated structure body of these dielectric materials and/or semiconductor materials may be utilized.

The thickness of the oscillation plate may be optimized based on the discharging capability. However, it is preferable that the thickness of the oscillation plate be within a range from 0.5 μm to 5 μm. The oscillation plate 20 that is too rigid may require a high drive power. When the oscillation plate 20 is flexible, its compliance is high. In this case, the discharging efficiency tends to be lowered and the oscillation plate 20 tends to be affected by the resonance.

The actuator 19 is formed on the oscillation plate 20. In general, the actuator 19 has a structure in which the lower electrode 23, the piezoelectric element 21, and the upper electrode 22 are laminated. As a material of the electrode, an arbitrary metal or conductor may be utilized. However, as a material of a portion of the electrode that contacts the piezoelectric element 21, it is preferable to use a conductive oxide material. It is preferable that an optimum material be selected for the electrode, depending on the physical property, the structure, and the constituent element of the piezoelectric element 21. Examples of the material include a platinum group oxide such as Iridium oxide and Palladium oxide, and complex oxides thereof; metal oxides of Ni, Zn, Sn, Ti, Ta, Nb, Mn, Sb, Bi, and Sb, and complex oxides thereof. An arbitrary piezoelectric material may be utilized for the piezoelectric element 21. However, it is preferable that lead zirconate titanate be utilized, from the viewpoints of the piezoelectric performance and the temperature stability. A known method may be used for forming the films of the piezoelectric element 21. Examples of the known method include a vacuum deposition method such as the sputtering and a liquid phase method where a solution of an organometallic compound is used. In the sputtering method, a film formation rate is low and a composition stability is low. Therefore, the mass productivity is low. The liquid phase method is preferable from the viewpoints of the mass productivity and the composition stability, compared to the sputtering method. In the liquid phase method, the piezoelectric material having desired material composition is obtained by applying an organometallic compound by using the spin-coating method and subsequently applying thermal processing. In any of the film formation methods, the film is crystallized so as to realize a high piezoelectric performance. The temperature for the crystallization depends on the film formation method and the material composition. Since the temperature for the crystallization is within a range from 500 degrees Celsius to 1000 degrees Celsius, it is preferable to use a metal with a high heat resistance or an electrically conducting material as a material of the electrode. A material having a high melting point and low reactivity is suitable for such a material. It is preferable that platinum group metals such as Pt, Ir, and Pd, compounds thereof, and alloys thereof be utilized as the material. Additionally, in order to prevent lead and oxygen of the piezoelectric element 21 from diffusing in the electrode during the thermal processing, and in order to prevent the material of the electrode from diffusing in the piezoelectric material, a diffusion preventing layer may be formed on the piezoelectric material interfaces of the upper electrode 22 and the lower electrode 23. It is preferable to use a conductive oxide as the diffusion preventing layer. A complex oxide of the above-described metals may be used.

Incidentally, it is not shown in the figures, but it is preferable to form a protective film at end portions of the actuator 19 and on the surface of the actuator 19. By forming the protective film, oxygen and moisture included in the air around the actuator 19 are prevented from reacting with the piezoelectric material, and thereby the durability of the actuator 19 can be improved. An arbitrary resin or insulator may be selected as a material of the protective film. However, an inorganic material is preferable, from the viewpoint of the ability to transmit the moisture and oxygen, As the inorganic material, it is preferable to use an oxide, a nitride, or a carbide of Al, Zr, Si, Ti, or Ta. The protective film may have the thickness with which the ability to transmit the moisture and oxygen can be ensured. At the same time, the protective film may have the film thickness that does not prevent the oscillation plate 20 from being deformed. Therefore, when the above-described inorganic material is utilized, it is preferable that the thickness of the film be within a range from 20 nm to 100 nm.

When a voltage is applied between the upper electrode 22 and the lower electrode 23 of the actuator 19, a stress is generated in the piezoelectric element 21 on the oscillation plate 20, and pressure is varied in the individual liquid chamber 17 by the deformation of the oscillation plate 20. The voltage is supplied from a driving circuit (not shown) to the actuator 19. In the first embodiment, the same wiring layer is patterned to the individual electrode 24 and to the common electrode 25, and the individual electrode 24 and the common electrode 25 are extended to the corresponding portions where the individual electrode 24 is connected to the driving circuit and the common electrode 25 is connected to the driving circuit. Here, the individual electrode 24 is connected to the upper electrode 22 so that the upper electrode 22 is connected to the driving circuit. The common electrode is connected to the lower electrode 23. With such a configuration, in the first embodiment, the individual electrode 24 and the common electrode 25 may be formed in a single patterning process (a film forming process, a photolithography process, and an etching process).

An arbitrary conductive material may be utilized as a material of the wiring layer. However, it is preferable to use a metal or an alloy, from the viewpoint of the resistance value. As the metal, Al, Au, Pt, Ag, Cu, Pd, Ir, W, Ni, Ta, Ti, Cr, and Mn may be used. In addition, an alloy and a metal compound of any of the above elements and an arbitrary element may be utilized. Since the mass production method has been established, it is preferable to use an alloy of Al or Cu, which is commonly used as a material of electrodes of a semiconductor.

In the embodiment, the individual electrode 24 is electrically connected to the upper electrode 22 through an individual electrode-upper electrode connecting portion 28. As shown in FIG. 4, in order to extend the individual electrode 24 through an area where the lower electrode 23 is formed, an insulator film 30 is disposed as an interlayer insulator film. With this, the lower electrode 23 is insulated from the individual electrode 24. As a material of the insulator film 30, an insulator film material that is commonly used for a semiconductor may be utilized. Examples of the insulator film material that is commonly used for a semiconductor include $SiO_2$ and $Si_3N_4$. Further, the insulator film 30 may have a layered structure in which plural insulator materials are laminated.

When the insulator film 30 is formed, the common electrode 25 is also formed on the interlayer insulator film, similar to the case of the individual electrode 24. The common electrode 25 is connected to the lower electrode 23 through a common connecting portion. The common electrode 25 is also extended to a connecting portion of the driving circuit, similar to the case of the individual electrode 24. An individual electrode connecting portion of the driving circuit is electrically connected to the individual electrode 24 through a contact hole 41 that is formed in the insulator film 30. Similarly, a common electrode connecting portion of the driving circuit is electrically connected to the common electrode 25 through another contact hole 41 that is formed in the insulator film 30.

When a wiring material such as Al or Cu that is commonly used for a semiconductor device is utilized, an insulator film 32 that protects the wiring may be required so as to prevent the corrosion of the wiring. The insulator film 32 covers an area where the wiring layer is formed, except the connecting portion that is connected to the driving circuit. An arbitrary material (an organic material and an inorganic material) may be utilized as a material of the insulator film 32. However, a material having a sufficiently low ability to transmit the moisture and oxygen is preferable. An inorganic material is preferably utilized as the material of the insulator film 32. It is preferable, for example, to utilize a metal oxide, a metal nitride, a metal carbide, and a complex compound thereof as the material of the insulator film 32. Specifically, it is preferable, for example, that an oxide, a nitride, and a carbide of Si, Al, Ti, and Ta are utilized as the material of the insulator film 32. Especially, when Al or an alloy material including Al as a main component is utilized, a generic method can be used. In the generic method $Si_3N_4$ is utilized. Further, when the insulator film 32 is removed from the area where the piezoelectric element 21 is formed, a deformation prevention effect on the oscillation plate 20 can be reduced.

In the inkjet head 200 according to the first embodiment, the fluid channel substrate 10 is joined to the supporting substrate 12. The supporting substrate 12 has a function to reinforce the stiffness of the fluid channel substrate 10. As shown in FIG. 5, when the portion above the liquid chamber partition wall 26 is supported by the supporting substrate partition wall 13, the interference between the neighboring individual liquid chambers 17 can be reduced. Here, the interference between the neighboring individual liquid chambers is generated through the oscillation plate 20, when the corresponding neighboring piezoelectric elements 21 are driven.

A suitable material may be selected as a material of the supporting substrate 12, from the viewpoints of the stiffness and the ability to be processed. An arbitrary metal, an inorganic material, or an organic material may be utilized. However, a Si substrate is preferably utilized, from the viewpoints of the high stiffness and the ability to be microfabricated. When the Si substrate is utilized, the supporting substrate partition walls 13 can be formed finely with a high precision by using the semiconductor manufacturing process (photolithography and etching).

Portions of the supporting substrate 12 are processed to have concave shapes that include the corresponding areas on the oscillation plate 20 where the actuators 19 are formed. The portions of the supporting substrate 12 that have been processed to have the concave shapes become the corresponding oscillation chambers 14. By providing the oscillation chamber 14, displacement of the oscillation plate 20 is not prevented during the deformation of the oscillation plate 20 by the drive of the piezoelectric element 21.

The joining portions of the supporting substrate 12 and the fluid channel substrate 10 can be joined by an arbitrary method. However, the joining portions are preferably joined by using a joining method where an adhesive is utilized. With the joining method where the adhesive is utilized, a wider range of materials can be used by suitably selecting the type of the adhesive. Usually, a resin material is utilized as the adhesive, Known adhesive technology may be utilized.

The supporting substrate 12 has openings corresponding to the portions of the individual electrodes 24 that are connected to the driving circuit and the portions of the common electrode 25 that are connected to the driving circuit, so that the individual electrodes 24 and the common electrode 25 can be connected to a driving signal source disposed outside the inkjet head 200. The individual electrode 24 is extended through the joining portion between the supporting substrate partition wall 13 and the fluid channel substrate 10 that partitions the oscillation chamber 14 of the supporting substrate 12.

Therefore, the layer structure of the joining portion between the supporting substrate 12 and the fluid channel substrate 10 includes the oscillation plate 20, the lower electrode 23, the insulator film 30 (interlayer insulator film), the individual electrode 24 (wiring layer), and the insulator film 32 (wiring protective layer). Among the elements included in the layer structure, the wiring of the individual electrode 24 that is formed as the wiring layer and the oscillation plate 20 are indispensable for the inkjet head 200 according to the first embodiment. Other layers may be omitted depending on the materials of the layers or the arrangement of the electrode. The wiring layers of the individual electrode 24 and the common electrode 25 are required for electrically connecting the individual electrode 24 and the common electrode 25 to the outside. Therefore, a pattern that is formed by the wiring layer (the layer that is the same as the layer of the individual electrode 24 and the common electrode 25) is disposed in the joining portion between the supporting substrate 12 and the fluid channel substrate 10.

In the inkjet head 200 according to the first embodiment, when the supporting substrate 12 is joined to the fluid channel substrate 10, the interference between the neighboring individual liquid chambers 17 is reduced by joining the liquid chamber partition wall 26, which partitions the individual liquid chamber 17, and the corresponding supporting substrate partition wall 13. The joining strength and the joining accuracy between the supporting substrate partition wall 13 and the fluid channel substrate 10 are important factors to reduce the interference between the neighboring individual liquid chambers 17.

In the first embodiment, the wiring layer that forms the individual electrode 24 and the common electrode 25 and that is included in the joining portion between the supporting substrate 12 and the fluid channel substrate 10 is extended to the opening of the supporting substrate 12. The joining portion between the supporting substrate partition wall 13 and the fluid channel substrate 10 has the same structure. In this manner, the layer structures of the joining portions between the supporting substrate 12 and the fluid channel substrate 10 have the same structure, and thereby improving the joining reliability and the joining strength.

Figure 6:
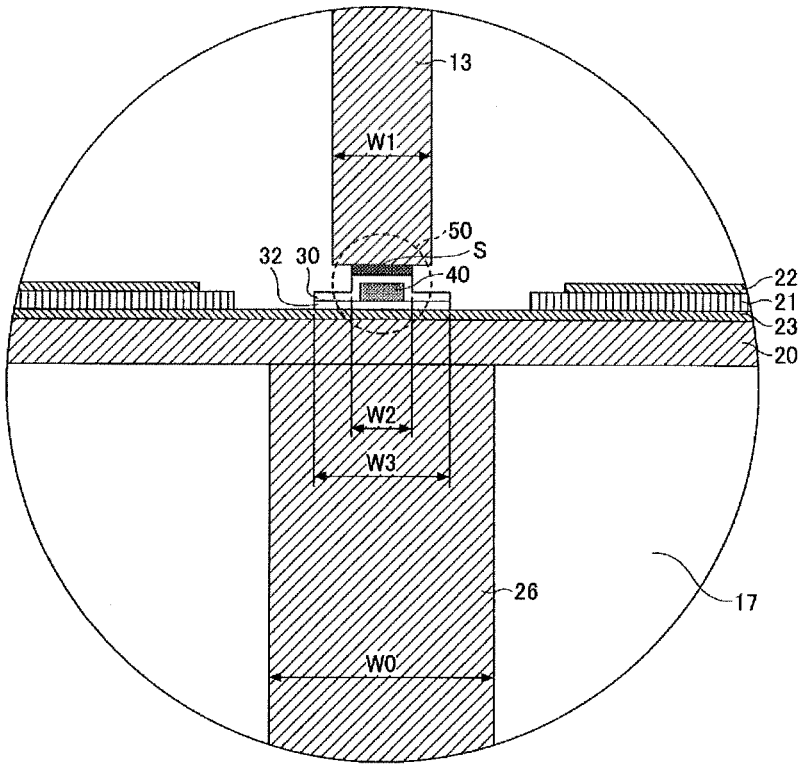
FIG. 6 is a diagram illustrating a joining portion between a fluid channel substrate and a supporting substrate.

Hereinafter, there will be explained the joining portions between the fluid channel substrate 10 and the supporting substrate 12 in the inkjet head 200 according to the first embodiment by referring to FIG. 6. FIG. 6 is a diagram illustrating the joining portion between the fluid channel substrate 10 and the supporting substrate 12.

In the first embodiment, when a width of the liquid chamber partition wall 26 is denoted by W0, a width of the supporting substrate partition wall 13 is denoted by W1, and a pattern width of the wiring layer 40 is denoted by W2, the inequality W0>W1>W2 is satisfied. As described above, the individual liquid chamber 17 of the fluid channel substrate 10 according to the first embodiment is formed by finely processing the fluid channel substrate 10 by the photolithography and the etching. However, since the process is a deep engraving process, it is possible that the processing accuracy varies. Specifically, side etching is applied to the portion of the fluid channel substrate 10 that interfaces with the oscillation plate 20, and the width W0 of the liquid chamber partition wall 26 at the side of the oscillation plate 20 tends to vary.

When the pattern width W2 of the wiring layer 40 is smaller than the width W0 of the liquid chamber partition wall 26, the joining reliability of the joining portion 50 between the supporting substrate 12 and the fluid channel substrate 10 does not depend on the width W0 of the liquid chamber partition wall 26. Further, when the width W1 of the supporting substrate partition wall 13 is greater than the pattern width W2 of the wiring layer 40, the width of the joining portion 50 between the supporting substrate 12 and the fluid channel substrate 10 and the position of the joining portion 50 can be determined with the accuracy of the pattern of the wiring layer 40.

Since the pattern of the wiring layer 40 is formed by applying the photolithography to a wiring material (thin film) that is commonly used in a semiconductor manufacturing process, the accuracy of the patterning is very high, and the pattern can be formed with the precision of less than or equal to 1 μm. On the other hand, the processing of the oscillation chamber 14 of the supporting substrate 12 (that is the processing of the supporting substrate partition wall 13) and the processing of the individual liquid chamber 17 (that is the processing of the liquid chamber partition wall 26) are the processing where the aspects of the depth and the width are close. The processing accuracy of the etching tends to be degraded compared to the case of the thin film.

Further, since the process of adhering the supporting substrate 12 with the fluid channel substrate 10 is a mechanically adhering process, the joining accuracy of the supporting substrate 12 and the fluid channel substrate 10 depends on the processing accuracy of the individual components, the precision of the alignment of the components, and positional shifts of the components that may occur when the components are pressed and heated at the time of the joining. Therefore, the precision of the alignment between the supporting substrate 12 and the fluid channel substrate 10 has been insufficient. When an existing joining facility was used, a positional shift of several μm was observed.

In the first embodiment, the amount of the positional shift at the joining portion 50 between the liquid chamber partition wall 26 and the supporting substrate partition wall 13 is reduced by setting the pattern width W2 of the wiring layer 40, which has the highest positional accuracy, to be the smallest width, and thereby improving the precision of the joining.

For example, in the first embodiment, even if the position of the supporting substrate 12 is shifted during the joining of the supporting substrate 12, fluctuation of an area of a joining surface S of the joining portion 50 and a positional shift of the center of the joining portion 50 do not occur, provided that the amount of the positional shift of the supporting substrate 12 is less than (W1−W2)/2. Therefore, it is preferable that W2 be less than W1.

Further, in the first embodiment, since the width W1 of the supporting substrate partition wall 13 is smaller than the width W0 of the liquid chamber partition wall 26, even if the position of the supporting substrate 12 is shifted, the supporting substrate partition wall 13 does not overlap the individual liquid chamber 17, provided that, the amount of the shift is less than (W0−W1)/2. Therefore, the effective width of the oscillation chamber 14 can be ensured.

If the width W0 of the liquid chamber partition wall 26 is smaller than the width Ni of the supporting substrate partition wall 13, the area of the oscillation chamber 14 is reduced when the position of the supporting substrate 12 at the joining portion 50 is shifted. Therefore, it is possible that the piezoelectric element 21 interferes with the oscillation chamber 14.

Therefore, in the first embodiment, the joining width of the supporting substrate 12, the position of the center of the joining portion of the supporting substrate partition wall 13, and the width of the oscillation chamber 14 can be secured by setting the widths W0, W1, and W2 so as to satisfy the inequality W0>W1>W2. Further, the layer structures of the joining portions 50 can be made uniform by including the wiring layer 40 in the layer structure of the joining portion 50. Therefore, the joining reliability can be improved. Further, in the first embodiment, the density of the individual liquid chambers 17 can be improved, and the interference between the neighboring individual liquid chambers 17 can be mitigated.

Second Embodiment

Hereinafter, a second embodiment of the present invention will be explained. In the second embodiment of the present invention, conditions are added to the first embodiment. Therefore, in the explanation of the second embodiment below, only the points that are different from those of the first embodiment are explained. The same reference numerals that have been used in the explanation of the first embodiment are added to the components having configurations that are the same as those of the first embodiment, and the explanations of the components are omitted.

In the second embodiment, there will be explained the insulator film 32 that is formed as the protective film on the wiring layer 40 and the insulator film 30 that is formed as the interlayer insulator film between the lower electrode 23 and the wiring layer 40.

The insulator film 30 according to the second embodiment is formed below the wiring layer 40 as the interlayer insulator film for the case where the individual electrode 24 is extended through the lower electrode 23. Further, the insulator film 32 is formed on the wiring as the protective film of the wiring layer 40. The insulator film 32 is formed in an area other than the portions where the wiring is connected to the driving circuit.

As described above, an arbitrary insulator material may be used as the material of the insulator film 30. However, $SiO_2$, which is a insulator material commonly used for a semiconductor device, is preferably used as the material of the insulator film 30. Further, adhesiveness of the insulator film 30 may be improved by laminating plural insulator films.

When generic Al or an alloy of Al is used for the wiring layer 40, $Si_3N_4$ is preferably used as the material of the insulator film 32.

When the insulator film 30 and the insulator film 32 are provided, as shown in FIG. 6, the layer structure that joins the liquid chamber partition wall 26 and the supporting substrate partition wall 13 includes the oscillation plate 20, the lower electrode 23, the insulator film 32, the wiring layer 40, and the insulator film 30.

In such a configuration, the wiring layer 40, the insulator film 30, and the insulator film 32 are indispensable. With such a configuration, the joining portion 50 may have the same layer structure as that of the portion from which the electrode is extended, and thereby the joining reliability is improved.

Further, the insulator films 30 and 32 may be required to be patterned, similar to the case of the wiring layer 40. In the second embodiment, when the pattern width of the insulator films 30 and 32 are denoted as W3, W2 and W3 satisfy the inequality W3>W2. With the above configuration, the end portions of the pattern of the wiring layer 40 can be covered with the insulator films 30 and 32. Therefore, insulation between the wiring layer 40 and the lower electrode 23 and protection of the wiring are ensured.

Additionally, in the second embodiment, W3 and W0 satisfy the inequality W3<W0. With such a condition, the insulator films 30 and 32 are not disposed above the area where the individual liquid chamber 17 is formed. Therefore, the insulator films 30 and 32 do not prevent the vibration displacement. Further, even if the processing accuracy is degraded during the formation of the individual liquid chamber 17, an amount of the positional shift less than (W0−W3)/W2 is allowed.

By setting the pattern width W3 of the insulator films 30 and 32 on the liquid chamber partition wall 26 so that W3 satisfies the inequality W2<W3<W0, the degree of freedom of the arrangement of the individual electrode 24 is improved by the insulator films 30 and 32, and the degree of freedom of the selection of the wiring materials is improved by the protection of the wiring, while demonstrating the effect of the first embodiment. Therefore, according to the second embodiment, downsizing and mass productivity of the inkjet head 200 can be ensured by higher integration.

Third Embodiment

Hereinafter, a third embodiment of the present invention will be explained. In the third embodiment of the present invention, conditions are added to the first embodiment and the second embodiment. Therefore, in the explanation of the third embodiment below, only the points that are different from those of the first and second embodiments are explained. The same reference numerals that have been used in the explanation of the first and second embodiments are added to the components having configurations that are the same as those of the first and second embodiments, and the explanations of the components are omitted.

The third embodiment assumes the case where the fluid channel substrate 10 and the supporting substrate 12 are joined by an adhesive 51. In the case where the adhesive 51 is used for the joining, it is preferable that the pattern width W3 of the insulator films 30 and 32 and the width W2 of the supporting substrate 12 satisfy the inequality W3>W1.

In the inkjet head 200 according to the second embodiment, the portion where the alignment precision becomes the worst (namely, the portion where the positional shift tends to occur) is the portion where the supporting substrate 12 and the fluid channel substrate 10 are aligned. Further, in the case where the adhesive 51 is used, when the adhesive 51, which has fluidity prior to hardening, is pressed, the adhesive that is pushed out of the joining portion 50 flows on the fluid channel substrate 10.

In the third embodiment, the adhesive 51 is prevented from flowing by the surface tension of the edge portions that have been formed by patterning the insulator films 30 and 32. However, in the case where the inequality W1>W3 is satisfied, the distance between the insulator film 30 and the supporting substrate partition well 13 is equal to the thickness of the adhesive 51 plus the thickness of the wiring layer 40. Therefore, the distance between the insulator film 30 and the supporting substrate partition wall 13 becomes several μm. In this case, since the adhesive 51 having the fluidity is dispersed by the capillary force, if the position of the supporting substrate 12 is shifted, the adhesive 51 flows toward the piezoelectric element 21 by passing through the patterns of the insulator films 30 and 32. When the adhesive 51 has flowed toward the piezoelectric element 21, a film is formed on the oscillation plate 20, and the film prevents the deformation of the oscillation plate 20. Therefore, the discharging performance is lowered.

Thus, in the third embodiment, the pattern width W3 of the insulator films 30 and 32 is adjusted with respect to the width W1 of the supporting substrate partition wall so that the inequality W3>W1 is satisfied. With such a configuration, the positional shift of the supporting substrate 12 does not affect the discharging performance.

Fourth Embodiment

Hereinafter, a fourth embodiment of the present invention will be explained. In the fourth embodiment, the ink supply channel 27 is formed in the supporting substrate 12. In the explanation of the fourth embodiment, only the points that are different from those of the first embodiment are explained. The same reference numerals that have been used in the explanation of the first embodiment are added to the components having configurations that are the same as those of the first embodiment, and the explanations of the components are omitted.

In the fourth embodiment, the ink supply channel 27 that supplies the ink to the individual liquid chamber 17 is formed in the supporting substrate 12. In this case, the ink supply port 27 is formed in the oscillation plate 20 as a through hole. In the fourth embodiment, the ink may contact a joining portion 53 between the supporting substrate 12 and the fluid channel substrate 10 in the vicinity of the ink supply port 27. Therefore, a layer structure may be required with which the ink can be sealed.

In the fourth embodiment, as shown in FIG. 4, a wiring pattern 29 including the ink supply channel 27 is patterned in the vicinity of the ink supply channel 27. With such a configuration, the joining portion 53 can have the layer structure that is the same as those of other areas. Therefore, the ability to seal the ink can be improved. Further, with such a configuration, the ink supply channel 27 can be arranged three-dimensionally. Therefore, the inkjet head 200 can be downsized.

The inkjet head and the recording device including the inkjet head have been explained above based on the embodiments. However, the present invention is not limited to the above-described embodiments, and various modifications and improvements may be made within a scope of the present invention.

The present application is based on Japanese Priority Application No. 2011-188339 filed on Aug. 31, 2011, the entire contents of which are hereby incorporated herein by reference.

What is claimed is:

1. An inkjet head comprising:

a fluid channel substrate on which individual liquid chambers are arranged in a short direction, wherein the individual liquid chambers are partitioned by liquid chamber partition walls, and the individual liquid chambers communicate with ink supply ports;

an oscillation plate that is formed on a surface facing openings of nozzles disposed in the corresponding individual liquid chambers;

actuators, wherein each of the actuators is formed by laminating a lower electrode, a piezoelectric element, and an upper electrode on the oscillation plate;

wiring layer patterns configured to supply driving signals to the corresponding actuators, wherein the wiring layer patterns are configured to connect individual electrodes to the corresponding upper electrodes and the wiring layer patterns are configured to connect a common electrode to the corresponding lower electrodes, wherein the wiring layer patterns are formed above the corresponding liquid chamber partition walls; and a supporting substrate in which concave oscillation chambers disposed at positions facing the corresponding actuators are formed, the concave oscillation chambers being partitioned by supporting substrate partition walls, wherein the supporting substrate partition walls are joined to the corresponding liquid chamber partition walls through laminated films including the wiring layer patterns, wherein a width in the short direction of each of the supporting substrate partition walls is smaller than a width in the short direction of each of the liquid chamber partition walls and greater than a width of each of the wiring layer patterns.

2. The inkjet head according to claim 1, wherein each of the laminated films includes a first insulator film and a second insulator film, the first insulator film being formed below the corresponding wiring layer pattern and the second insulator film being formed above the corresponding wiring layer pattern, wherein the first insulator film and the second insulator film are patterned so as to include the corresponding wiring layer pattern, and wherein a pattern width of the first insulator film and the second insulator film is greater than the width of the corresponding wiring layer pattern and smaller than the width of the corresponding liquid chamber partition wall.

3. The inkjet head according to claim 1, wherein the ink supply ports are formed as through holes that pass through the oscillation plate, and wherein, in the vicinity of each of the ink supply ports, the supporting substrate is joined to the fluid channel substrate through the corresponding laminated film including the corresponding wiring layer pattern.

4. The inkjet head according to claim 2, wherein the pattern width of the first insulator film and the second insulator film is greater than the width of the supporting substrate partition wall.

5. A recording device comprising:

an inkjet head, wherein the inkjet head includes a fluid channel substrate on which individual liquid chambers are arranged in a short direction, wherein the individual liquid chambers are partitioned by liquid chamber partition walls, and the individual liquid chambers communicate with ink supply ports;

an oscillation plate that is formed on a surface facing openings of nozzles disposed in the corresponding individual liquid chambers;

actuators, wherein each of the actuators is formed by laminating a lower electrode, a piezoelectric element, and an upper electrode on the oscillation plate;

wiring layer patterns configured to supply driving signals to the corresponding actuators, wherein the wiring layer patterns are configured to connect individual electrodes to the corresponding upper electrodes and the wiring layer patterns are configured to connect a common electrode to the corresponding lower electrodes, wherein the wiring layer patterns are formed above the corresponding liquid chamber partition walls; and a supporting substrate in which concave oscillation chambers disposed at positions facing the corresponding actuators are formed, the concave oscillation chambers being partitioned by supporting substrate partition walls, wherein the supporting substrate partition walls are joined to the corresponding liquid chamber partition walls through laminated films including the wiring layer patterns, wherein a width in the short direction of each of the supporting substrate partition walls is smaller than a width in the short direction of each of the liquid chamber partition walls and greater than a width of each of the wiring layer patterns.

* * * * *